US010448668B2

(12) United States Patent
Xiong

(10) Patent No.: US 10,448,668 B2
(45) Date of Patent: Oct. 22, 2019

(54) PORTABLE SMOKING INSTRUMENT

(71) Applicant: ZHONGSHEN DAQI ELECTRONICS CO., LTD., Guangdong (CN)

(72) Inventor: Li Gao Xiong, Guongdong (CN)

( * ) Notice: Subject to any disclaimer, the term of this patent is extended or adjusted under 35 U.S.C. 154(b) by 111 days.

(21) Appl. No.: 15/691,777

(22) Filed: Aug. 31, 2017

(65) Prior Publication Data

US 2019/0037915 A1 Feb. 7, 2019

(30) Foreign Application Priority Data

Aug. 3, 2017 (CN) ..... 2017 1 0654933

(51) Int. Cl.
*A24F 13/16* (2006.01)

(52) U.S. Cl.
CPC ..... *A24F 13/16* (2013.01)

(58) Field of Classification Search
None
See application file for complete search history.

(56) References Cited

U.S. PATENT DOCUMENTS 3,827,444 A * 8/1974 Khan ..... A24F 13/16 131/174
4,236,539 A * 12/1980 Mosby, Jr. ..... A24F 13/16 131/175
2010/0192963 A1* 8/2010 Chau ..... A24F 19/0071 131/240.1

* cited by examiner

*Primary Examiner* — Michael H. Wilson
*Assistant Examiner* — Katherine A Will
(74) *Attorney, Agent, or Firm* — Prakash Nama; Global IP Services, PLLC

(57) ABSTRACT

A portable smoking instrument comprising a cigarette bar internally provided with an inner cavity allowing a cigarette to be inserted therein and an ash storage part separately connected with the cigarette bar, wherein both ends of the inner cavity are communicated with the outside, and a through hole communicated with the inner cavity is formed in the surface of the cigarette bar; the ash storage part is provided with an ash storage inner cavity communicated with the inner cavity of the cigarette bar. The portable smoking instrument is convenient to use and operate and can be applied and promoted easily, thereby preventing negative influences of smoking on environmental sanitation.

6 Claims, 3 Drawing Sheets

PORTABLE SMOKING INSTRUMENT

BACKGROUND OF THE INVENTION

The invention relates to the technical field of smoking instruments, in particular to a portable smoking instrument.

At present, people generally drop cigarette ash onto the ground habitually when smoking outdoors, and consequentially negative influences on environment sanitation are caused; smokers have to find a dustbin for preventing cigarette ash from being dropped on the ground, and inconvenience is caused. In addition, passersby can be scalded incautiously or smokers can scald themselves during smoking, and dangers are likely to be caused. Furthermore, after smoking, quite a part of people habitually drop cigarette butts on the ground, certain cigarette butts are even sparking, negative influences to environment sanitation are caused, and passersby are prone to being scalded.

BRIEF SUMMARY OF THE INVENTION

For overcoming the defects of the prior art, the invention aims to provide a portable smoking instrument; cigarette ash can be collected when people smoke and is prevented from falling onto the ground, and the situation that people are scalded can be effectively avoided.

For realizing the above purposes, the following technical scheme is adopted by the invention:

A portable smoking instrument comprises a cigarette bar, wherein an inner cavity allowing a cigarette to be inserted therein is formed inside the cigarette bar, and both ends of the inner cavity are communicated with the outside; a through hole communicated with the inner cavity is formed in the surface of the cigarette bar; the portable smoking instrument further comprises an ash storage part, the ash storage part is provided with an ash storage inner cavity, and the ash storage inner cavity is communicated with the inner cavity of the cigarette bar.

As a preferred scheme, the portable smoking instrument comprises a jacket, wherein the jacket is internally provided with a jacket inner cavity with both ends being communicated with the outside, the jacket inner cavity allows the cigarette bar to be movably inserted therein, a vent hole communicated with the jacket inner cavity is formed in the surface of the jacket, and the through hole is communicated with the vent hole when the cigarette bar moves to a set position in the jacket inner cavity; the jacket is separately connected with the ash storage part, and the jacket inner cavity is communicated with the ash storage inner cavity.

As another preferred scheme, the ash storage part is an outer box body, and an ash storage box which can be separated from the outer box body is arranged in the ash storage inner cavity of the outer box body; in addition, the outer box body is provided with a smoking hole allowing the cigarette bar to be inserted therein, and the smoking hole is communicated with the ash storage box.

Furthermore, the outer box body further comprises a cigarette bar storage hole allowing the cigarette bar to be inserted therein.

Furthermore, the portable smoking instrument further comprises a storage jacket, wherein the storage jacket is provided with a storage jacket inner cavity allowing the cigarette bar to be movably inserted therein, the inner cavity of the cigarette bar is communicated with the storage jacket inner cavity, a vent hole communicated with the storage jacket inner cavity is formed in the surface of the storage jacket, and the through hole of the cigarette bar is communicated with the vent hole of the storage jacket when the cigarette bar moves to a set position in the storage jacket inner cavity; the cigarette bar storage hole can allow the storage jacket to be separately inserted therein.

Furthermore, a sealing cap which is matched with the smoking hole and can seal or open the smoking hole is formed in the outer box body. Furthermore, the sealing cap is rotatably connected to the outer box body.

Furthermore, corresponding screw holes are formed in the sealing cap and the outer box body, one end of a screw penetrates through the screw holes of the sealing cap and the outer box body to enter the outer box body and then penetrates through a jacket column to be connected with a lock nut in a threaded mode through a gasket, and the jacket column is sleeved with a spring; the outer diameter of the jacket column is larger than that of the screw hole of the outer box body, and both the gasket and the inner wall of the outer box body apply pressure to the spring; the sealing cap can rotate relative to the outer box body around the screw.

The portable smoking instrument described above can further comprise an anti-leakage plug matched with the other end of the cigarette bar.

The portable smoking instrument of the invention has the beneficial effects of being convenient to use and operate and can be applied and promoted easily, thereby preventing negative influences of smoking on environmental sanitation.

DETAILED DESCRIPTION OF THE INVENTION

A further description of the invention is given as follows with accompanying drawings, it should be pointed out that detailed execution modes and specific operation processes are given in the following embodiments based on the technical scheme, however, the protection scope of the invention is not limited to the following embodiments.

First Embodiment

Figure 1:
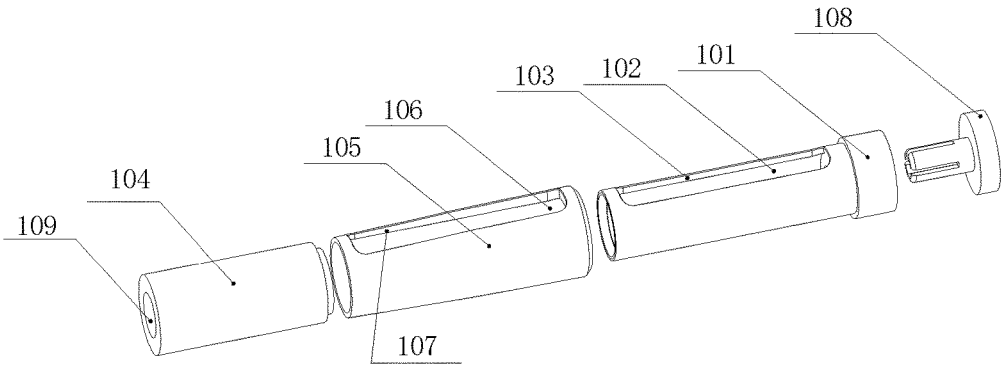
FIG. 1 is a structural schematic diagram of a first embodiment of the invention.

As is shown in FIG. 1, a portable smoking instrument comprises a cigarette bar 101, wherein an inner cavity 102 allowing a cigarette 100 to be inserted therein is formed inside the cigarette bar 101, and both ends of the inner cavity 102 are communicated with the outside; a through hole 103 communicated with the inner cavity 102 is formed in the surface of the cigarette bar 101; the portable smoking instrument further comprises an ash storage part 104, the ash storage part 104 is provided with an ash storage inner cavity, and the ash storage inner cavity is communicated with the inner cavity 102 of the cigarette bar. In the embodiment, the ash storage part is approximately in a cylinder shape, the interior of the ash storage part is hollow to form the ash storage inner cavity, one end of the ash storage inner cavity is communicated with the outside, and the other end of the ash storage inner cavity is sealed.

Figure 3:
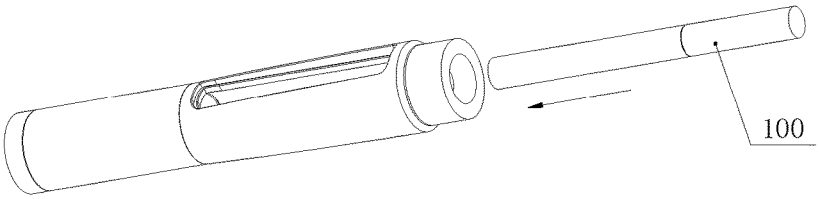
FIG. 3 is a schematic diagram of FIG. 1 in the use state.

In the embodiment, as is shown in FIG. 3, a cigarette 100 is ignited and then inserted into the inner cavity 102 of the cigarette bar 101, and oxygen is supplied for cigarette burning through the through hole 103. Burnt cigarette ash at the end of the cigarette can automatically drop into the ash storage inner cavity of the ash storage part 104, searching for a dustbin is not needed, and pollution to environment sanitation can be avoided. After smoking, a cigarette butt is placed into the cigarette bar and falls into the ash storage part through the cigarette bar, using is fast and convenient, and people can be assisted in changing the habit of habitually throwing cigarette butts onto the ground. Finally, the ash storage part is separated from the cigarette bar, and then the cigarette ash and the cigarette butts in the ash storage inner cavity are cleared away.

Figure 2:
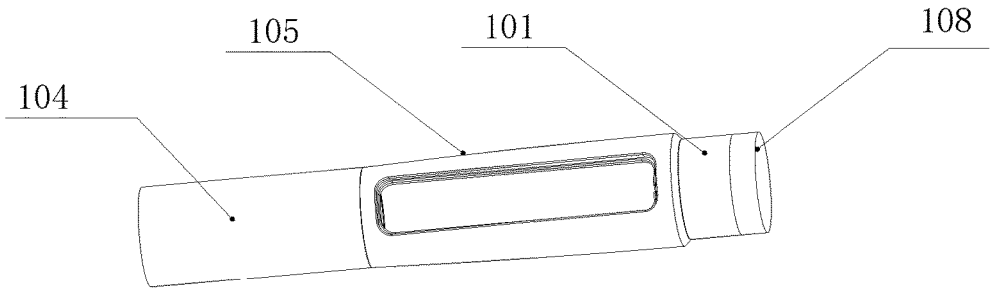
FIG. 2 is a schematic diagram of FIG. 1 in the combined state.

The portable smoking instrument comprises a jacket 105, wherein the jacket 105 is provided with a jacket inner cavity 106 with both ends being communicated with the outside, the jacket inner cavity 106 allows the cigarette bar 101 to be movably inserted therein, the inner cavity 102 of the cigarette bar 101 is communicated with the jacket inner cavity 106, a vent hole 107 communicated with the jacket inner cavity 106 is formed in the surface of the jacket 105, and the through hole 103 is communicated with the vent hole 107 when the cigarette bar 101 moves (rotates in the embodiment) to a set position in the jacket inner cavity 106; the jacket 105 is separately connected with the ash storage part 104, and the jacket inner cavity 106 is communicated with the ash storage inner cavity. The combined state schematic diagram shown in FIG. 2 refers to the state in which the through hole corresponds to the vent hole.

Furthermore, the portable smoking instrument comprises an anti-leakage plug 108 matched with the other end of the cigarette bar 101. In the embodiment, a groove 109 matched with the anti-leakage plug 108 is formed in the other end of the ash storage part 104; during smoking, the anti-leakage plug 108 can be taken out to be inserted into the groove 109, thereby being prevented from getting lost.

In the using state, when the cigarette bar is rotated until the through hole of the cigarette bar corresponds to the vent hole of the jacket inner cavity, oxygen can be supplied for cigarette burning. After use, the cigarette bar is rotated until the through hole of the cigarette bar is staggered from the vent hole of the jacket inner cavity, the interior of the whole smoking instrument can be kept being isolated from the outside through the anti-leakage plug 108, residual sparks can be promoted to be extinguished, and cigarette ash can be prevented from spreading out from the through hole and the vent hole. The anti-leakage plug can prevent cigarette ash in the ash storage part from falling out when people do not smoke.

Second Embodiment

Figure 4:
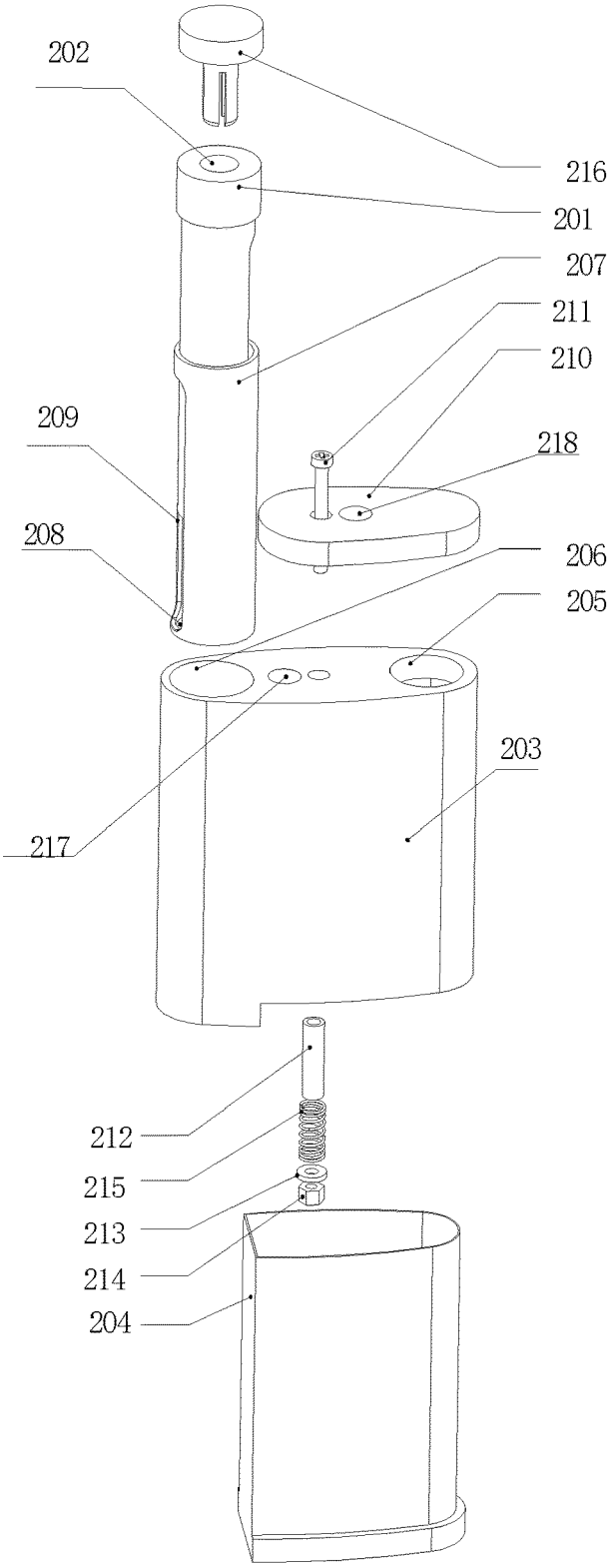
FIG. 4 is a structural schematic diagram of a second embodiment of the invention.
Figure 5:
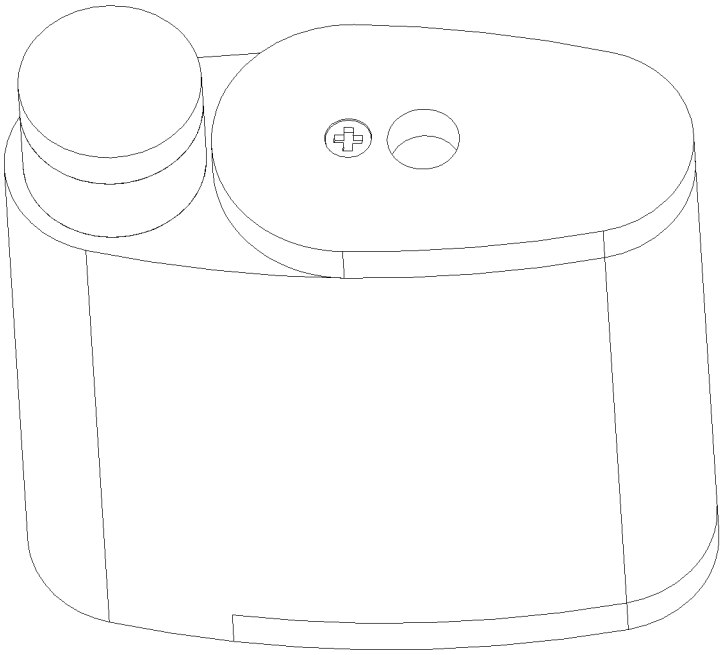
FIG. 5 is a schematic diagram of FIG. 4 in the combined state.

As is shown in FIG. 4, the portable smoking device comprises a cigarette bar 201, wherein an inner cavity 202 allowing a cigarette to be inserted therein is formed inside the cigarette bar 201, and both ends of the inner cavity 202 are communicated with the outside; a through hole communicated with the inner cavity 202 is formed in the surface of the cigarette bar 201; the portable smoking instrument further comprises an ash storage part 203, the ash storage part 203 is provided with an ash storage inner cavity, and the ash storage inner cavity is communicated with the inner cavity 202 of the cigarette bar.

The second embodiment is similar to the first embodiment in that during smoking, a cigarette bar is ignited and then inserted into the inner cavity 202 of the cigarette bar 201, and oxygen is supplied for cigarette burning through the through hole. Burnt cigarette ash at the end of the cigarette can automatically drop into the ash storage inner cavity of the ash storage part 203, searching for a dustbin is not needed, and pollution to environment sanitation can be avoided. After smoking, the ash storage part is separated from the cigarette bar, and then the cigarette ash in the ash storage inner cavity is cleared away.

In the embodiment, the ash storage part 203 is an outer box body, and an ash storage box 204 which can be separated from the outer box body is arranged in the ash storage inner cavity of the outer box body; in addition, the outer box body is provided with a smoking hole 205 allowing the cigarette bar to be inserted therein, and the smoking hole 205 is communicated with the ash storage box 204. In use, the cigarette bar 201 is inserted into the smoking hole 205 and connected with the smoking hole 205, a cigarette is ignited and then inserted into the cigarette bar 201, and then cigarette ash generated in the smoking process can fall into the ash storage box 204; after smoking, a cigarette butt is placed into the cigarette bar and enters the ash storage box through the cigarette bar, using is fast and convenient, and the habit of people habitually throwing cigarette butts onto the ground can be changed effectively. The ash storage box 204 is taken out of the outer box body, and then cigarette ash and cigarette butts in the ash storage box 204 are removed. Since the volume of the ash storage box is large, the ash storage box does not need to be cleaned every time and only needs to be cleaned when the ash storage box is almost full of cigarette ash and cigarette butts. In the embodiment, the ash storage box is placed into the ash storage inner cavity of the outer box body in a sleeved mode from the bottom of the outer box body, and the bottom of the ash storage box is clamped and fixed to the bottom of the outer box body.

Furthermore, the outer box body further comprises a cigarette bar storage hole 206 which can allow the cigarette bar 201 to be inserted therein. When people do not smoke, the cigarette bar 201 can be placed in the cigarette bar storage hole 206 to be stored. The cigarette bar storage hole 206 is isolated from the smoking hole.

After use, the cigarette bar can be inserted into the cigarette bar storage hole, the inner diameter of the cigarette bar storage hole can be designed to be matched with the outer diameter of the cigarette bar, and thus the cigarette bar is not prone to falling out of the cigarette bar storage hole after being inserted into the cigarette bar storage hole.

Preferably, the portable smoking instrument further comprises a storage jacket 207, wherein the storage jacket 207 is provided with a storage jacket inner cavity 208 which can allow the cigarette bar 201 to be movably inserted therein, the inner cavity of the cigarette bar 201 communicates with the storage jacket inner cavity 208, a vent hole 209 which is communicated with the storage jacket inner cavity 208 is formed in the surface of the storage jacket 207, and the through hole of the cigarette bar is communicated with the vent hole 209 of the jacket inner cavity 208 when the cigarette bar 201 moves (rotates in the embodiment) to a set position in the storage jacket inner cavity 208; the cigarette bar storage hole 206 allows the storage jacket 207 to be separately inserted therein. In the embodiment, the structure of the storage jacket and the cigarette bar is the same as the structure of the jacket and the cigarette bar in the first embodiment.

Under the condition that the storage jacket is arranged, the cigarette bar can be placed in the cigarette bar storage hole after being sleeved with the storage jacket, and since the inner diameter of the cigarette bar storage hole is matched with the inner diameter of the storage jacket, the cigarette bar is not prone to falling out after being inserted into the cigarette bar storage hole.

Furthermore, the outer box body 203 is provided with a sealing cap 210 which is matched with the smoking hole 205 and can seal or open the smoking hole 205. Furthermore, the sealing cap 210 is rotatably connected to the outer box body 203. When people do not smoke, the smoking hole can be sealed through the sealing cap, then residual cigarette ash in the outer box body can be prevented from falling out of the outer box body, and non-extinguished sparks can be promoted to be extinguished.

Furthermore, corresponding screw holes are formed in the sealing cap 210 and the outer box body 203, one end of a screw 211 penetrates through the screw holes of the sealing cap 210 and the outer box body 203 to enter the outer box body 203 and then penetrates through a jacket column 212 to be connected with a lock nut 214 in a threaded mode through a gasket 213, and the jacket column 212 is sleeved with a spring 215; the outer diameter of the jacket column 212 is larger than that of the screw hole of the outer box body 203, and both the gasket 213 and the inner wall of the outer box body 203 apply pressure to the spring 215; the sealing cap 210 can rotate relative to the outer box body 203 around the screw 211.

In the embodiment, the portable smoking instrument can further comprise an anti-sealing plug 216 matched with the other end of the cigarette bar 201. Furthermore, in the embodiment, an anti-leakage plug insertion hole 218 and an anti-leakage plug insertion hole 217 which correspond to each other in position are formed in the sealing cap 210 and the outer box body 203 respectively, during smoking, the taken-out anti-leakage plug 216 is sequentially inserted into the anti-leakage plug insertion hole 218 and the anti-leakage plug insertion hole 217, so that the anti-leakage plug is well placed when people smoke and prevented from getting lost. FIG. 4 shows a state schematic diagram when people do not smoke, the two anti-leakage plug insertion holes 218, 217 are staggered, so that cigarette ash is prevented from falling out from the anti-leakage plug insertion holes when people do not smoke. When people smoke, the sealing cap is unscrewed from the smoking hole, the anti-leakage plug insertion holes 218, 217 correspond to each other in position, and the anti-leakage plug 216 is allowed to pass through the anti-leakage plug insertion holes 218, 217.

Through a rotating mechanism mentioned above, the jacket column abuts against the inner wall of the outer box body, the screw can be positioned and stabilized under the effect of the spring and is prevented from shaking in the rotating process of the sealing cap, and thus the sealing cap can rotate more stably.

Third Embodiment

On the basis that other structures of the embodiment are basically the same as those of the second embodiment, the portable smoking instrument further comprises an ash storage end, wherein the interior of the ash storage end is hollow, one end portion of the ash storage end is communicated with the outside, and the other end portion of the ash storage end is sealed; one end portion of the ash storage end is separately connected to the storage jacket, and the interior of the ash storage end is communicated with the inner cavity of the storage jacket. In the embodiment, the structure of the ash storage end is the same as the ash storage part shown in the first embodiment. By arranging the ash storage end, when a user smokes, the outer box body can be selectively used for storing ash, or the cigarette bar can be selectively pulled out to be inserted into the storage jacket, the ash storage end is connected to the storage jacket, and then a smoking way similar to that in the first embodiment is achieved.

For those skilled in the field, various corresponding changes and transformations can be made according to the above technical scheme and design, and all the changes and transformations should be within the protection scope of the claims of the invention.

What is claimed is:

1. A portable smoking instrument, comprising a cigarette bar;

characterized in that an inner cavity allowing a cigarette to be inserted therein is formed inside the cigarette bar, and both ends of the inner cavity are communicated with the outside; a through hole communicated with the inner cavity is formed in the surface of the cigarette bar;

the portable smoking instrument further comprises an ash storage part separately connected with the cigarette bar, the ash storage part is provided with an ash storage inner cavity, and the ash storage inner cavity is communicated with the inner cavity of the cigarette bar;

the ash storage part is an outer box body, and an ash storage box which can be separated from the outer box body is arranged in the ash storage inner cavity of the outer box body; in addition, the outer box body is provided with a smoking hole allowing the cigarette bar to be inserted therein, and the smoking hole is communicated with the ash storage box;

a sealing cap which is matched with the smoking hole and can seal or open the smoking hole is formed in the outer box body;

the sealing cap is rotatably connected to the outer box body;

corresponding screw holes are formed in the sealing cap and the outer box body, one end of a screw penetrates through the screw holes of the sealing cap and the outer box body to enter the outer box body and then penetrates through a jacket column to be connected with a lock nut in a threaded mode through a gasket, and the jacket column is sleeved with a spring; the outer diameter of the jacket column is larger than that of the screw hole of the outer box body, and both the gasket and the inner wall of the outer box body apply pressure to the spring; the sealing cap can rotate relative to the outer box body around the screw.

2. The portable smoking instrument according to claim 1, characterized by further comprising a jacket, wherein the jacket is internally provided with a jacket inner cavity with both ends being communicated with the outside, the jacket inner cavity allows the cigarette bar to be movably inserted therein, a vent hole communicated with the jacket inner cavity is formed in the surface of the jacket, and the through hole is communicated with the vent hole when the cigarette bar moves to a set position in the jacket inner cavity; the jacket is separately connected with the ash storage part, and the jacket inner cavity is communicated with the ash storage inner cavity.

3. The portable smoking instrument according to claim 1, characterized in that the outer box body further comprises a cigarette bar storage hole allowing the cigarette bar to be inserted therein.

4. The portable smoking instrument according to claim 3, characterized by further comprising a storage jacket, wherein the storage jacket is provided with a storage jacket inner cavity allowing the cigarette bar to be movably inserted therein, the inner cavity of the cigarette bar is communicated with the storage jacket inner cavity, a vent hole communicated with the storage jacket inner cavity is formed in the surface of the storage jacket, and the through hole of the cigarette bar is communicated with the vent hole of the storage jacket when the cigarette bar moves to a set position in the storage jacket inner cavity; the cigarette bar storage hole can allow the storage jacket to be separately inserted therein.

5. The portable smoking instrument according to claim 4, characterized by further comprising an ash storage end, wherein the interior of the ash storage end is hollow, one end portion of the ash storage end is communicated with the outside, and the other end portion of the ash storage end is sealed; said one end portion of the ash storage end is separately connected to the storage jacket, and the interior of the ash storage end communicates with the storage jacket inner cavity.

6. The portable smoking instrument according to claim 1, characterized by further comprising an anti-leakage plug matched with an end of the cigarette bar from which the cigarette is inserted.

* * * * *